United States Patent [19]

Rutz et al.

[11] Patent Number: 4,923,123

[45] Date of Patent: May 8, 1990

[54] SPRAY COATING DEVICE FOR ATOMIZATION OF FLUID COATING MATERIAL

[75] Inventors: Guido Rutz, Gossau; Daniel Seiler, Jona, both of Switzerland

[73] Assignee: Ransburg-Gema AG, St. Gallen, Switzerland

[21] Appl. No.: 268,808

[22] Filed: Nov. 8, 1988

[30] Foreign Application Priority Data

Nov. 12, 1987 [DE] Fed. Rep. of Germany ..... 3738378

[51] Int. Cl.[5] ..... B05B 5/04; B05B 5/08; B05B 3/02; B05B 3/18

[52] U.S. Cl. ..... 239/691; 239/694; 239/700; 118/321; 118/323; 118/626

[58] Field of Search ..... 239/690, 691, 694, 700, 239/752; 118/321, 323, 626

[56] References Cited

U.S. PATENT DOCUMENTS

| | | | |
|---|---|---|---|
| 2,754,226 | 7/1956 | Juvinall | 118/626 |
| 3,130,066 | 4/1964 | Brady | 239/694 |
| 3,362,642 | 1/1968 | Freeman et al. | 118/323 |
| 3,735,924 | 5/1973 | Wirth | 239/694 |
| 4,011,833 | 3/1977 | Hawkins | 118/323 |
| 4,182,980 | 1/1980 | Tholome | 318/467 |

FOREIGN PATENT DOCUMENTS

| | | | |
|---|---|---|---|
| 913520 | 6/1954 | Fed. Rep. of Germany . | |
| 1557637 | 5/1969 | Fed. Rep. of Germany | 239/694 |
| 3319665 | 12/1984 | Fed. Rep. of Germany . | |
| 3334047 | 2/1985 | Fed. Rep. of Germany . | |

*Primary Examiner*—Andres Kashnikow
*Assistant Examiner*—Karen B. Merritt
*Attorney, Agent, or Firm*—Barnes & Thornburg

[57] ABSTRACT

A spray disk (4) rotating at high speed and connected to high voltage surrounds a guide rod (30) and can be reciprocated up and down along said guide rod, the latter being of a stationary arrangement. This permits the use of drive means (34, 50) which extend along the guide rod (30) so that for the up and down motion of the spray disk (4) there are no carrier rods required which protrude beyond the stroke of the spray disk beyond the device.

10 Claims, 3 Drawing Sheets

SPRAY COATING DEVICE FOR ATOMIZATION OF FLUID COATING MATERIAL

Figure 1:
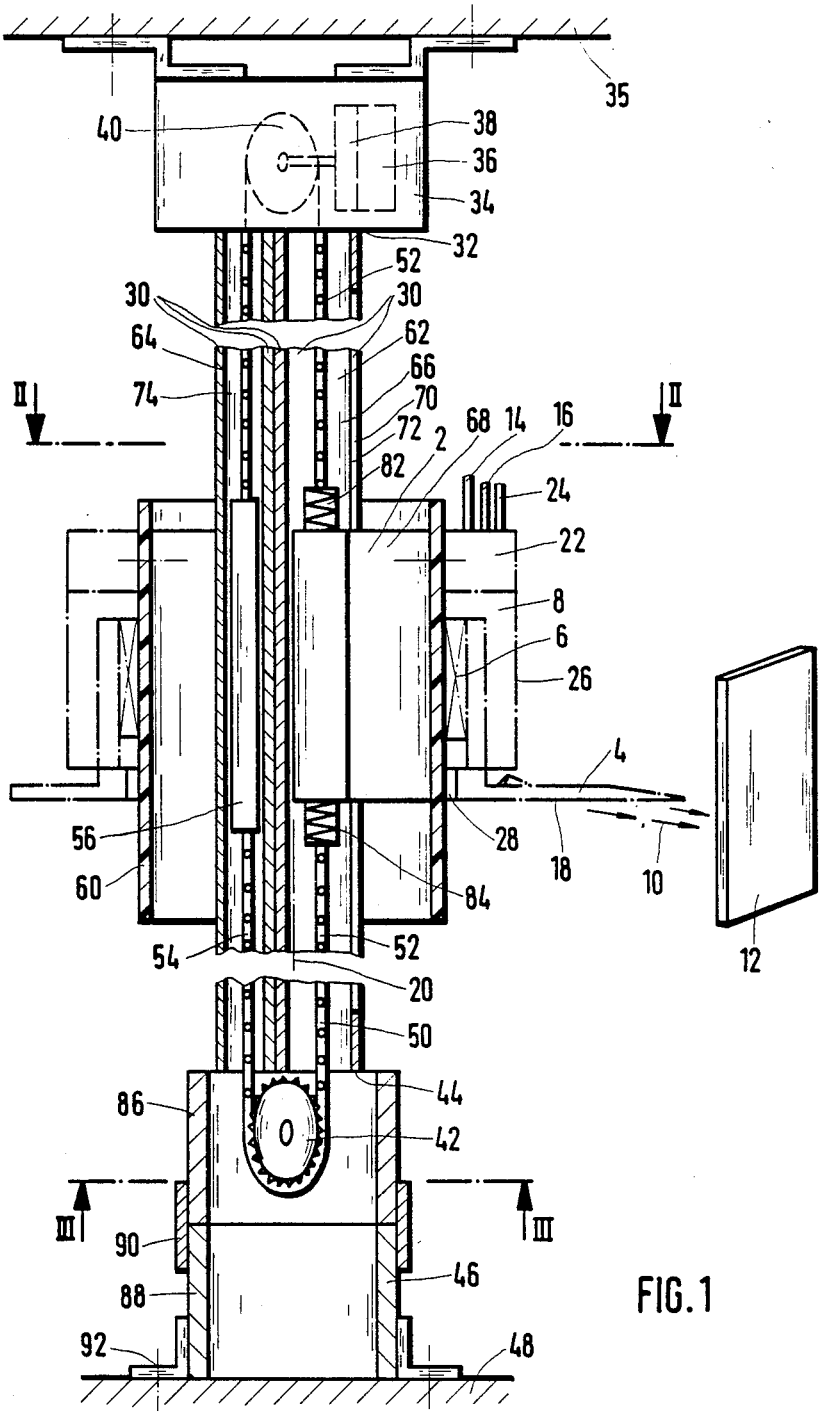

The invention relates to a spray coating device for atomization of fluid coating material.

In prior spray coating devices of this type, the axis of rotation of the spray disk is arranged vertically with the spray disk being arranged at the bottom end of a carrier rod. The latter is movable vertically up and down by a reciprocating drive. The stroke of this up and down movement may range up to 7 m. This means that the overall height, consisting of the stroke and the carrier rod protruding beyond it in the uppermost position of the spray disk, amounts to totally at least 14 m. A rotary drive of the spray disk may be an electromotor or a turbine drive by air. The fluid coating material atomized by the spray disk forms around the spray disk a fluid coating material particle cloud in which articles to be coated are moved around the spray disk along a circular path. The articles may at the same time rotate about their own axes so as to be coated by the fluid coating material around their entire circumference. To coat the entire height of the objects or to coat several stacked objects simultaneously, the spray disk must not only be rotated but also be reciprocated vertically across said stroke. Thus, the stroke equals at least the height of one article to be coated. The spray disk is electrically charged, so that between it and the articles to be coated, which normally are connected to ground potential, an electrical field is created by which the atomized fluid coating material particles are forced to follow a trajectory to the articles. The electrical charging of the spray disk also causes the fluid coating material to be charged electrically, so that the fluid coating material particles will cling through electrical forces of attraction to the articles being coated. Thus, the spray coating device serves the so-called "electrostatic fluid coating" of articles. Hydraulic cylinders serving as reciprocating drives for the carrier rod must be considerably sturdier in their design than would be required by the weight of the spray disk, in order to keep the spray disk sufficiently stable. The reciprocating motions of the spray disk must be smooth, fast, uniform and free of vibration.

The problem which the invention seeks to solve is reducing the large space required for the stroke of the spray disk while providing a design where the actuator drive for the spray disk needs to have only a size such as required for the actuating forces, without requiring an overdimensioning of the actuator for purposes of a stable mounting of the spray disk.

According to the invention, a spray coating device for atomization of fluid coating materials includes a spray disk which is rotatably arranged on a carrier, can be electrically charged, is rotatable relative to the carrier, and is axially movable with the carrier by an actuator. The device is characterized in that: a motor for driving the spray disk is arranged on the carrier; a high voltage generator circuit is contained on the carrier for generating a DC high voltage which is connected to the spray disk; the spray disk is ring-shaped; the ring-shaped spray disk, the motor and the high voltage generator circuit form together an assembly of annular shape with a central opening; the assembly is mounted on the carrier; the assembly with the ring-shaped disk surrounds a guide rod which is arranged stationary and which extends through the central opening; and, the carrier together with the assembly including the spray disk is axially movable along the guide rod relative to the guide rod by an actuator.

The invention offers several advantages: The space required for the spray coating device, in the stroking direction of the spray disk, is reduced to one-half as compared to prior devices, since according to the invention there is no carrier rod required which protrudes beyond the stroke of the spray disk. The guide rod used according to the invention can be fixed on one or both ends so as to be stationary, either on a machine frame or on building parts. As a result, the actuator need not absorb appreciable guidance forces, or none at all, for the guide rod, so that the actuator need be designed only as large as required for the axial motion of the spray disk. The guide rod may be fashioned as a hollow body, that it will at the same time prevent a contamination of components that are needed for the axial motion of the spray disk. At the same time, the invention also solves the problem deriving from the fact that the spray disk must not have a selectively large, but a minimal diameter.

Figure 2:
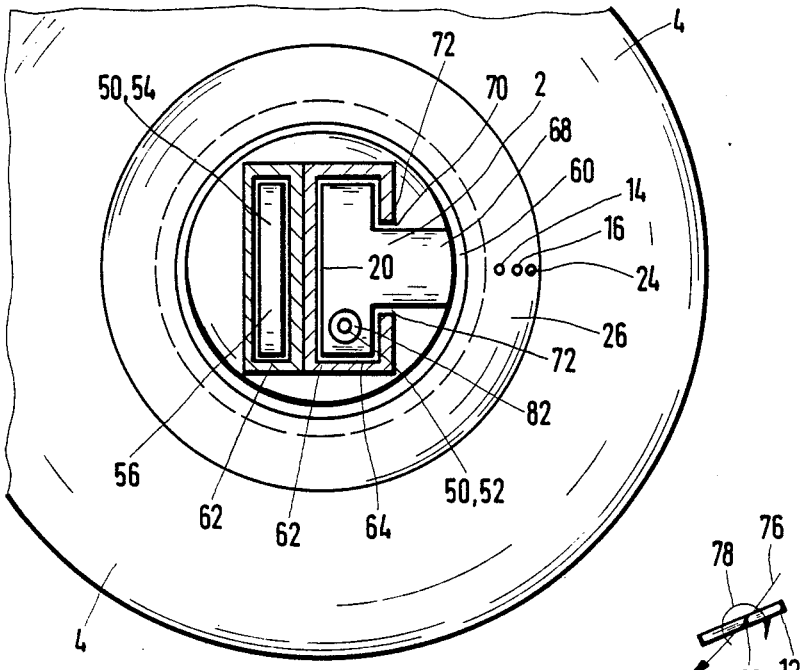
Figure 3:
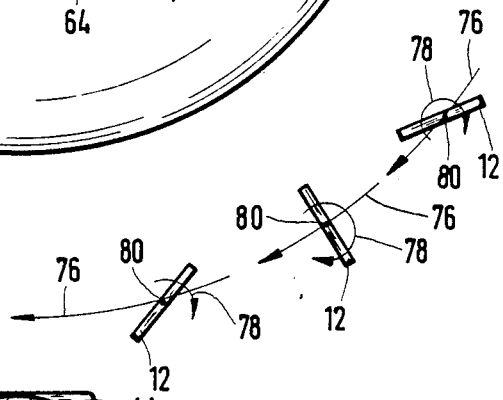
Figure 3:
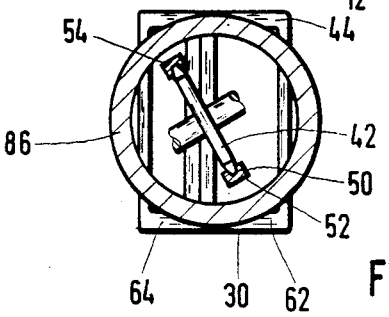
Figure 4:
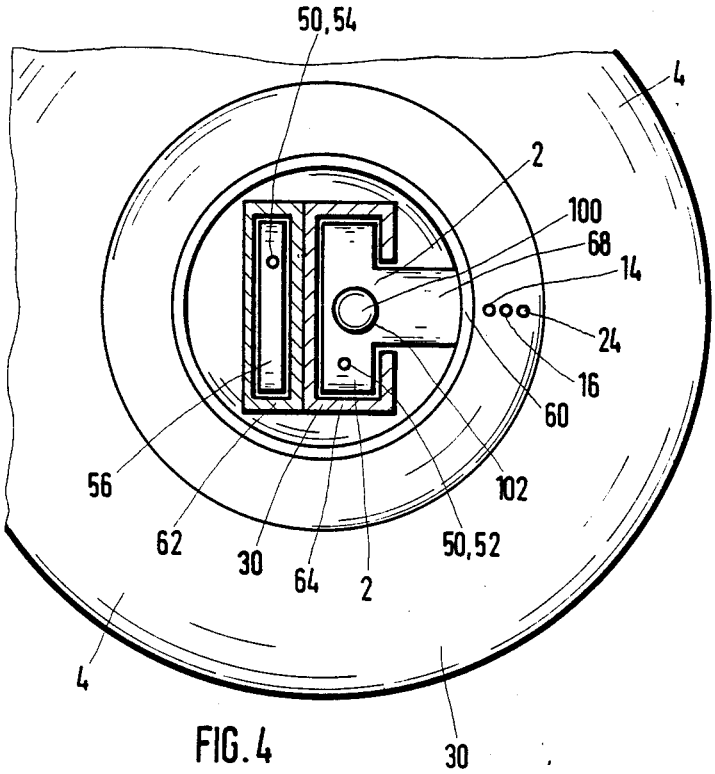

The invention will be described hereafter with reference to the drawing, which shows several preferred embodiments as examples. In detail, the drawings show in FIG. 1, a spray coating device according to the invention with an electrically charged spray disk which rotates at high speed and can be moved vertically up and down;

FIG. 2, a sectional illustration along the plane II—II in FIG. 1;

FIG. 3, a sectional illustration along the plane III—III, viewed in the direction of the arrow, and FIG. 4, a sectional illustration of another embodiment of a spray coating device according to the invention, viewed at a sectional point corresponding to II—II of FIG. 1.

The basic idea of the invention is constituted by the stationary arrangement of a vertical guide rod and that the spray disk surrounds the guide rod and that it can be reciprocated up and down along the guide rod, without moving the guide rod. This makes it possible to use for the up and down motion of the spray disk, axially to its axis of rotation, an actuator with a drive device that extends along the guide rod without extending beyond the stroke of the spray disk by the length of said stroke. The invention makes it possible for the spray coating device to essentially be only as high as the stroke of the axially movable spray disk and an actuator invariable in height.

The inventional spray coating device illustrated in FIG. 1 for electrostatic spray coating of articles with fluid coating material comprises a carrier 2 on which, drawn in broken line, a spray disk 4 is arranged so as to be rotatable on a bearing 6. The spray disk 4 is driven at a very high speed of rotation by a motor 8 arranged on the carrier 2 and atomizes fluid coating material 10 onto an article 12 to be coated. The motor 8, in a fashion known as such, may be an electromotor or an air turbine motor known as such which, depending on motor type, is supplied with electrical energy or compressed air through a line 14. The fluid coating material 10 is fed to the spray disk 4 in a fashion known as such, through a fluid line 16, and sprayed by it on its front 18, due to its very high speed of rotation, in the form of a fluid coating material cloud 10 onto the articles 12 being coated. The axis of rotation of the spray disk 4 is marked 20.

Contained on the carrier 2, additionally and drawn by broken line, is a high voltage generator circuit 22 which through an electrical line 24 can be connected to a low voltage supply of, e.g., 10 V and is capable of generating a DC high voltage up to 100 kV that is connected to the spray disk 4 for electrically charging the fluid coating material 10 and causing it to be electrically attracted by the grounded articles 12. The spray disk 4, bearing 6, motor 8 and voltage generator circuit 22 form together an assembly 26 of annular shape with a central opening 28 in which the carrier 2 is located. The assembly 26 is mounted on the carrier 2 as an exchangeable unit.

The assembly 26 with the spray disk 4 surrounds a guide rod 30 which extends through the central opening 28, is of stationary arrangement and, the same as the axis of rotation 20 of the spray disk 4, arranged vertically. Mounted on the upper end 32 of the guide rod 30 is the actuator 34 which, in turn, is mounted on a building ceiling 35. The actuator 34 comprises an actuator motor 36 in the form of an electromotor and a sprocket 40 which is driven through a transmission 38. A second sprocket 42 is located opposite the bottom end 44 of the guide rod 30, in a support 46 through which the guide rod 30 is attached to the building floor 48. A chain drive 50 runs on the two sprockets 40 and 42. Attached to the section 52 of the chain drive 50 shown in FIG. 1, right, is the carrier 2 which, depending on the direction of rotation of the sprockets 40 and 42, is moved up or down. Attached to the section 54 of the chain drive 50, shown on the left in FIG. 1, is a counterweight 56 which in weight equals approximately the assembly 26 with the spray disk 4. Thus, the actuator 34, and specifically its actuator motor 36, needs to be designed only for the small capacity which is required for overcoming the frictional resistances in the actuator including its drive connection—gear wheels 40 and 42 and chain drive 50—with the carrier 2. But the actuator 34 needs no capacity for supporting the weight of the carrier 2 and the assembly 26 attached to it.

Arranged between the carrier 2 and the assembly 26 is an insulating tube 60 from electrically insulating material which extends concentrically with the spray disk 4 through the central opening 28 and protrudes axially in both longitudinal directions beyond the spray disk 4 and the assembly 26. The insulating tube 60 surrounds the guide rod 30. The insulating tube 60 prevents thereby an electrical arc-over between the spray disk 4 carrying high voltage and the guide rod 30 as well as between the spray disk 4 and the carrier 2.

The guide rod 30 is a hollow body and includes two mutually connected, cross-sectionally rectangular tubes 62 and 64. The carrier 2 runs in the hollow space 66 of the tube 62 in its longitudinal direction and has a driver component 68 which protrudes out of an oblong slot 70 in the tube 62 and is prevented from rotating by the rims 72 of said slot. Attached to the driver 68 of the carrier 2 is the assembly 26 with the spray disk 4. The hollow space 74 of the other tube 64 accommodates the counterweight 56, which runs in it in the longitudinal tube direction, in that the cross section of the hollow space 74 is only slightly larger than the cross section of the counterweight 56.

FIG. 2 shows that each tube 62 and 64 has a rectangular cross section and that both tubes 62 and 64 together have as well a rectangular cross section. Also, FIG. 2 shows that the articles 12 to be coated travel along arrows 76 on a circular path around the spray disk 4 while rotating at the same time, according to arrows 78, about axes of rotation 80 which lie axially parallel to the axis of rotation 20 of the spray disk 4.

From FIG. 1 it follows also that the right-hand section 52 of the chain drive 50 connects with the carrier 2 through shock absorber devices 82 and 84 which dampen jolts in the actuation direction of the carrier 2. The shock absorber devices 82 and 84 may be springs or rubber elements or similar elastic means.

According to FIG. 1, the support 46 consists of an upper tube section 86 that houses the gear wheel 42, a lower tube section 88, a retaining ring 90 surrounding both tube sections 86 and 88, and fastening means 92 with which the bottom tube section 88 is fastened on the building floor 48. By shifting the upper tube section 86 upward or radially removing the lower tube section 88 it is possible to form a space through which the spray disk 4 and, if so desired, the entire assembly 26 can be slipped downwardly off the guide tube 30 and removed radially.

The diameter of the spray disk 4 should be as small as possible and should not exceed a specific size. This means that its central opening 28 is small. But it also means that the components extending through the central opening 28, specifically the guide rod 30, must as well have a very small diameter. This makes the spacing of the two hollow spaces 66 and 74 of the tubes 62 and 64 of the guide rod 30 very small. To nevertheless obtain a sufficiently large distance between the two sections 52 and 54 of the chain drive 50, the gear wheels 40 and 42 are arranged diagonally to the rectangular cross section which is given jointly by the two tubes 62 and 64. This is evident not only from FIG. 1 by the oval illustration of the sprockets 40 and 42, but specifically also from FIG. 3, showing the lower sprocket 42 and the guide rod 30 from below.

In the embodiment according to FIGS. 1 through 3 of the drawings, a chain drive 50 is provided as connection between the actuator 34 and the carrier 2 of the spray disk 4. In a modified embodiment, a cogged belt could be used as well. Both have the advantage that a specific angular position of the actuator motor 36 corresponds exactly to a specific height position of the spray disk 4. The same advantage is obtained when instead of the chain drive 50 a lead screw 100, illustrated in FIG. 4, extends in the longitudinal direction of the guide rod 30 through the carrier 2 and meshes with it through a threading 102. In this case, the carrier 2 with the spray disk 4 is moved as well vertically along the guide rod 30 as the actuating motor 36 of the actuator 34 rotates the lead screw 100. Disregarding the exception described here, the embodiment illustrated in FIG. 4 has all the elements as the embodiment illustrated in FIG. 1, for which reasons these elements are not described once more in detail. The chain drive 50 may as well be used in the embodiment illustrated in FIG. 4, but with the difference that the transmission 38 of the actuator is connected not with the upper sprocket 40 but with the lead screw 100.

What is claimed is:

1. Spray coating device for atomization of fluid coating material, with a spray disk (4) which is rotatably arranged on a carrier (2), can be electrically charged, is rotatable relative to the carrier (2) and axially movable together with the carrier by an actuator (34), characterized in that a motor (8) for driving the spray disk (4) is arranged on the carrier (2); a high voltage generator circuit (22) is contained on the carrier (2) for generating a DC high voltage which is connected to the spray disk (4); the spray disk (4) being ring-shaped; the ring-shaped spray disk (4), the motor (8) and the high voltage generator circuit (22) form together an assembly (26) of annular shape with a central opening (28); the assembly (26) is mounted on the carrier (2); the assembly (26) with the ring-shaped spray disk (4) surrounds a guide rod (30) which is arranged stationary and which extends through the central opening (28) in the ring-shaped spray disk (4); the carrier (2) together with the assembly (26) including the spray disk (4) is axially movable together with the spray disk (4) along the guide rod (30), relative to said guide rod (30), by an actuator (34).

2. Spray coating device according to claim 1, characterized in that for protection against electrical arc-overs between the spray disk (4) and the guide rod (30) said spray disk (4) is arranged on the outside circumference of an insulating tube (60) from electrically insulating material which surrounds the guide rod (30) on part of its length and which together with the spray disk (4) is movable along the guide rod.

3. Spray coating device according to claim 1, characterized in that a counterweight (56) to the weight of the masses, including the mass of the spray disk (4) and the carrier (2), is provided which by the actuator (34) are moved along the guide rod (30), the arrangement of the latter being vertical and stationary.

4. Spray coating device according to claim 3, characterized in that the counterweight (56) is movably installed in a guide (64, 74) that extends along the guide rod (30).

5. Spray coating device according to claim 1, characterized in that the actuator (34) and carrier (2) of the spray disk (4) are connected with each other through a drive connection (50, 40, 42) which features a shock absorber device (82, 84) for damping jolts in the direction of actuation of the spray disk (4).

6. Spray coating device according to claim 1, characterized in that the actuator (34) is through a drive connection (50) in drive connection with the carrier (2) of the spray disk (4), said drive connection comprising a chain or cogged belt.

7. Spray coating device according to claim 1, characterized in that the guide rod (30) is a hollow body (62, 64) which has an oblong slot (70) in which the carrier (2) of the spray disk (4) is installed movably in the axial direction of the guide rod.

8. Spray coating device according to claim 6, characterized in that the guide rod (30) is a cross-sectionally rectangular hollow body (62, 64), in that outside the guide rod (30), at least opposite one end (44), there is a gear wheel (40, 42) arranged diagonally to the guide rod (30), across which gear wheel (42) runs the gear wheel entrainment element (50).

9. Spray coating device according to claim 1, characterized in that at least one end (44) of the guide rod (50) connects through a removable adapter (46, 86, 88) detachably with an apparatus part or building part (48), and in that the adapter (46, 86, 88) has a size such that upon removal of said adapter a space is created which has a size that is sufficient for the axial removal of the spray disk (4) from the guide rod (30) and the subsequent radial removal of the spray disk (4) from the guide rod (30).

10. Spray coating device according to claim 1, characterized in that the actuator (34) is through a drive connection (40, 42, 50 in FIG. 1; 100, 102 in FIG. 4) drivably connected with the carrier (2) of the spray disk (4), which drive connection extends along the guide rod (30) at least across the axial actuation travel of the spray disk along the guide rod (30), irrespective of the position of the spray coating disk (4) along the guide rod (30).

* * * * *